United States Patent [19]

Callecod

[11] 4,068,842

[45] Jan. 17, 1978

[54] CHILD RECREATION STRUCTURE

[75] Inventor: Robert L. Callecod, Long Lake, Minn.

[73] Assignee: Recreation Systems Co., North Aurora, Ill.

[21] Appl. No.: 693,014

[22] Filed: June 4, 1976

[51] Int. Cl.[2] ..... A63B 9/00

[52] U.S. Cl. ..... 272/113; 46/20

[58] Field of Search ..... 272/113, 109, 112, 110; 46/29, 27, 28, 20, 19; 52/169; 61/47

[56] References Cited

U.S. PATENT DOCUMENTS

| | | | |
|---|---|---|---|
| 1,901,964 | 3/1933 | Haskell | 272/113 |
| 2,123,016 | 7/1938 | McDaniel | 61/47 |
| 2,648,539 | 8/1953 | Packer | 272/113 |
| 2,704,667 | 3/1955 | Sanders | 272/113 |
| 3,611,619 | 10/1971 | Testa | 46/20 X |
| 3,730,520 | 5/1973 | Willis | 272/113 X |

OTHER PUBLICATIONS

"Gym-Dandy Lookout Tower" - Playthings Magazine, vol. 62, No. 1, p. 17, Jan. 1964.

*Primary Examiner*—William R. Browne
*Attorney, Agent, or Firm*—Darbo & Vandenburgh

[57] ABSTRACT

Side walls of spaced horizontal rails inclined inwardly to a horizontal platform provide a safe climbing challenge to children on a complex recreation structure. A vertical pole in the center of an opening in the platform offers the thrill of sliding down into the interior of the structure. An open doorway provides access to the interior. The interrelated complexity of the structure offers challenge and stimulation to the children. The side walls include spaced horizontal rails each of which rests upon and extends beyond a rail of adjoining sides. A horizontal user's platform is positioned at the uppermost limit of the walls spanning an area defined by the tops of the walls. The pole is unsupported by the platform and the walls.

2 Claims, 5 Drawing Figures

5
2
5
6
5
4
7
3
3

6
4
2
5
4
7
2
1
2

5
2

CHILD RECREATION STRUCTURE

BACKGROUND AND SUMMARY OF THE INVENTION

The need of children for physical activity and development has resulted in the provision of a wide variety of playground equipment such as swings, slides, merry-go-rounds and the like. While such apparatus stimulates play, including physical activity, the limits of the notoriously short interest spans of children are quickly reached on playground equipment of this kind. In using a slide, for example, children soon weary of climbing the steps to the top and sliding down, even though they may try sliding in lying position after a few slides in sitting position, etc. Challenges are limited and quickly satisfied and the equipment loses its attraction to the child.

A careful study of the propensities of children vis-a-vis play equipment has indicated that conventional playground equipment does not satisfy the needs of children for mental as well as physical development. Having quickly met the challenge and accomplished the use of each available piece of equipment in turn, the child looks about for other adventures. Children's play is an arousal seeking behavior and children play for the stimulation that they receive, not just to burn up energy. The lack of complexity, that is, the inability of an apparatus to offer something of an order beyond its most obvious, basic function, is believed to be the primary deficiency of the traditional slide, seesaw, etc. Intriguing novelty, imagination stimulating complexity and challenge that will not be denied are lacking in such conventional equipment.

The object of the invention herein described is to provide a structurally simple, yet functionally complex, child recreation structure which offers countless uses limited only by the imaginations of the children. A further object is to provide such a structure that appeals to a wide range of individual temperments and which, while challenging the children to vigorous physical activity, is safe to use. Another object is to provide such a structure which, due to its diversity of recreational activity, may be used concurrently by a large number of children playing together or independently.

The form of the structure and the manner in which these objectives are achieved will become apparent as the detailed description of the invention proceeds.

DESCRIPTION OF THE DRAWINGS

In the accompanying drawings.

DESCRIPTION OF PREFERRED EMBODIMENT

While the number of sides of the recreation structure is a matter of choice, a six-sided plan has been selected as optimum for purposes of description of a preferred embodiment of the invention.

For permanence, the structure is preferably built upon a concrete footing 1. The sides of the structure are formed by rails 2 which are laid in courses with each rail resting at its end upon the ends of the rails of the adjoining sides, as shown, so that they are spaced apart. The rails of each course are shorter than those of the course upon which they rest so that as the wall is built it inclines inwardly as it rises. Preferably, 4 × 4 or 4 × 6 timbers are used with the outer side of each course in approximate alignment with the inner side of the next lower course.

The bottom rails are fastened to the footing and the rails are bolted together where they cross each other.

Figure 1:
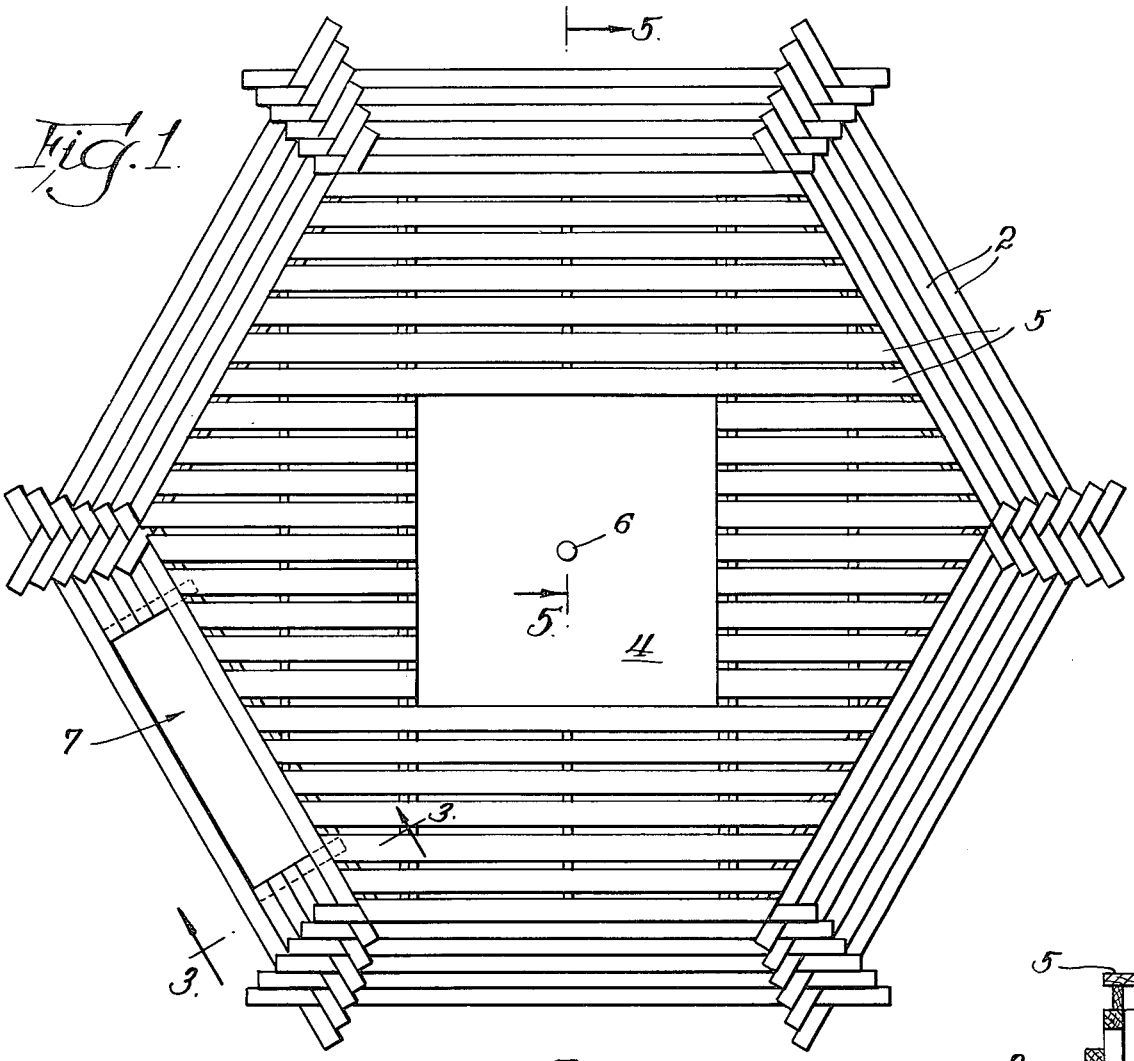
FIG. 1 is a plan view of the child recreation structure of the invention.
Figure 2:
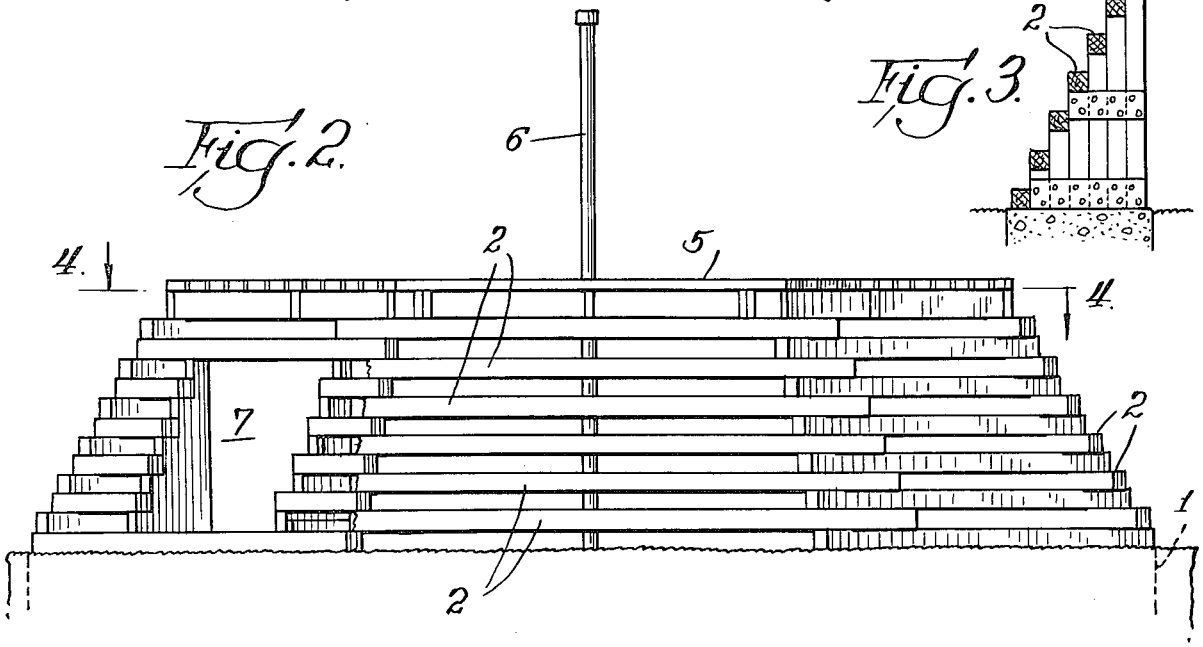
FIG. 2 is an elevational view.
Figure 3:
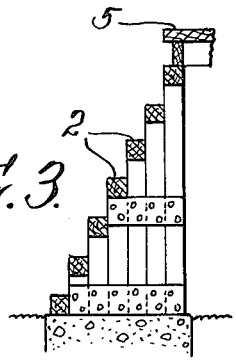
FIG. 3 is a detail view, in cross section, taken at the line 3—3 of FIG. 1.
Figure 4:
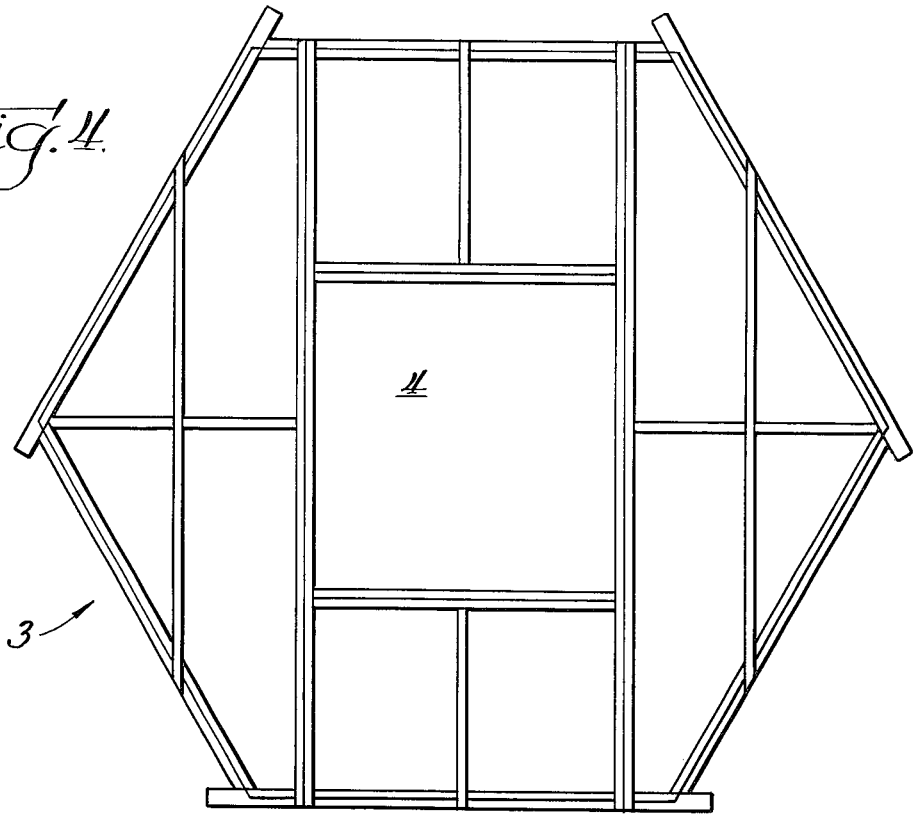
FIG. 4 is a plan view of the top platform supporting structure.
Figure 5:
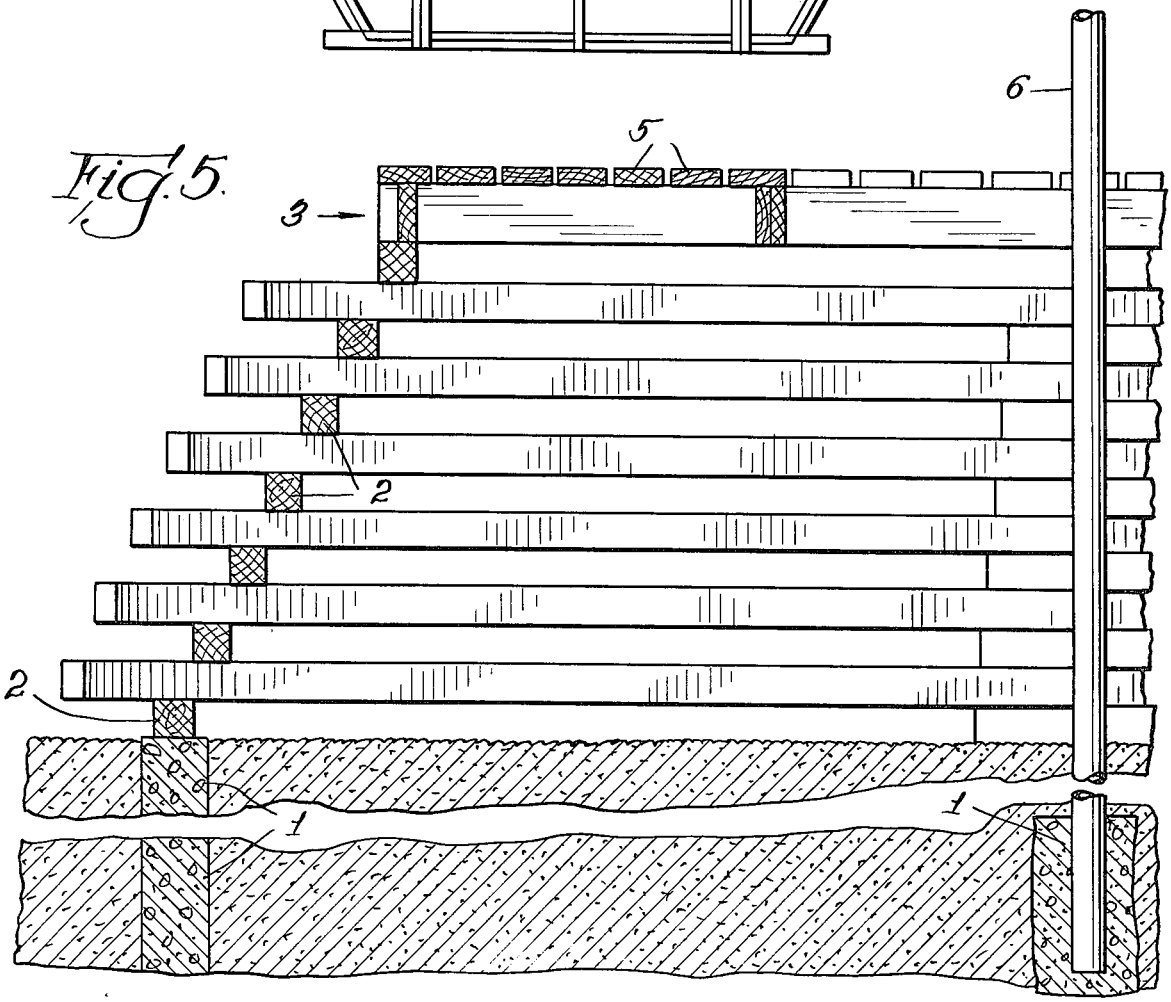
FIG. 5 is a cross-sectional view taken at the line 5—5 of FIG. 1

At a height of about 4½ feet, the platform supporting frame 3, shown in FIG. 4, is built upon and bolted to the top course of side wall rails. The frame provides an opening 4 in its center and is otherwise covered by boards 5 which may be nailed or otherwise secured to frame 3.

A pole 6 is firmly mounted in the ground, preferably in concrete a shown, and rises vertically at the center of opening 4 to a point well above the platform formed by boards 5. Since the pole is to be used for sliding down to the ground from the platform, it is preferably made of metal. A length of pipe, approximately 1½ inches in diameter, is suitable.

A doorway 7 is provided for access to the interior of the structure. Suitable framing members or timber supports 8 define the doorway and support the ends of the rails at the doorway.

While the recreation structure has been described by way of example as composed of six side walls, structures suitable for the purposes of the invention may reasonably have from four to eight sides. The ends of the rails extend beyond the junctures with the rails of adjoining sides, providing stairways sufficiently more precarious to challenge children to further adventure climbing up to the platform or balancing in descent to the ground.

USE OF RECREATION STRUCTURE

The child recreation structure is simple in construction but complex from the psychological standpoint in that it offers an almost unlimited variety of uses and challenges to the child. Many children can be climbing up the sides to experience success when they reach the platform. Because the walls are not vertical, but inclined, the danger of losing a grip and falling is practically non-existent. having arrived at the platform, the children can either grab the pole and slide down to the ground, emerge from the enclosure through the doorway and climb up again, or try balancing as they walk down the side, step by step. They can sit on the rails and dangle their legs as they watch other, and possibly older performers play fireman as they slide down the pole. An audience is always stimulating to performance. Or, for those less inclined to challenging physical activity, the structure provides a clubhouse in which to sit and enjoy the feeling of having their own space.

For those more capable or driven by the natural inclination to show their prowess, climbing the pole with a struggle to the platform is a challenge or walking up or down on the very ends of the rails.

Children will constantly outdo each other thinking of new tricks to perform on the recreation structure. Because of the wide diversity of possibilities, the structure will remain attractive for long periods of time thus serving its intended purpose of promoting both physical and mental development.

If desired, the platform may be used for the production of skits as a group activity. If the pole is removably mounted in a permanent socket in the ground, it can be withdrawn and the hole covered so that the entire platform can be used when this is desirable.

I claim:

1. A child recreation structure comprising at least four side walls arranged to form a polygonal enclosure, each of said walls comprising spaced horizontal rails each of which rests upon and extends beyond a rail of adjoining sides, said walls inclining inwardly, a horizontal platform for supporting a user of the structure at the uppermost limit of the walls and, spanning the area defined by the tops of all of said walls, said having a central opening therein, and a vertical pole mounted and arranged at approximately the center of said opening and extending above said platform of sliding from said platform down into the interior of said structure, said pole being completely unsupported by the walls and the platform, one of said walls having an open doorway therein to permit passage therethrough by a user of the structure.

2. A recreation structure in accordance with claim 1 wherein the side walls are composed of wooden 4 × 4 rails so arranged that the outer vertical surface of each lies in approximately the plane of the inner vertical surface of the next lower rail in each wall.

* * * * *

UNITED STATES PATENT AND TRADEMARK OFFICE

CERTIFICATE OF CORRECTION

PATENT NO. : 4,068,842

DATED : January 17, 1978

INVENTOR(S) : Robert L. Callecod

It is certified that error appears in the above-identified patent and that said Letters Patent are hereby corrected as shown below:

Col. 2, l. 2 "end" before "upon" should be --ends--

Col. 3, l. 12 before "having" insert --platform--

Col. 4, l. 2 before "sliding" "of" should be --for--

Signed and Sealed this

Ninth Day of May 1978

[SEAL]

Attest:

RUTH C. MASON
Attesting Officer

LUTRELLE F. PARKER
Acting Commissioner of Patents and Trademarks